US007134750B2

(12) United States Patent
Hasebe et al.

(10) Patent No.: US 7,134,750 B2
(45) Date of Patent: Nov. 14, 2006

(54) INK JET PRINTER

(75) Inventors: Takashi Hasebe, Hachioji (JP); Saburo Shimizu, Hachioji (JP); Tetsu Sekine, Hachioji (JP); Shuta Hamada, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 279 days.

(21) Appl. No.: 10/829,156

(22) Filed: Apr. 22, 2004

(65) Prior Publication Data

US 2005/0041053 A1 Feb. 24, 2005

(30) Foreign Application Priority Data

Aug. 19, 2003 (JP) ..... 2003-295263

(51) Int. Cl.
*B41J 2/01* (2006.01)

(52) U.S. Cl. ..... 347/102; 347/30; 347/33

(58) Field of Classification Search ..... 347/102, 347/14, 17, 33, 30
See application file for complete search history.

(56) References Cited

U.S. PATENT DOCUMENTS 3,456,538 A * 7/1969 Barton et al. ..... 83/171
4,751,528 A * 6/1988 Spehrley et al. ..... 347/18
2003/0128264 A1 7/2003 Ishikawa et al.
2003/0133003 A1 7/2003 Nedblake, Jr. et al.
2004/0041893 A1* 3/2004 Hoshino ..... 347/102

FOREIGN PATENT DOCUMENTS

EP 0 885 721 A2 12/1996
JP 2002-283545 10/2002

OTHER PUBLICATIONS

European Search Report.

* cited by examiner

*Primary Examiner*—Stephen Meier
*Assistant Examiner*—Ly T. Tran
(74) *Attorney, Agent, or Firm*—Finnegan, Henderson, Farabow, Garrett & Dunner, L.L.P.

(57) ABSTRACT

An ink jet printer having: an ink heating device for heating an ink whose viscosity decreases as temperature increases; a printing head for jetting an ink heated by the heating device onto a recording medium; a carrying device for carrying the recording medium while supporting the recording medium to face a nozzle-plate of the printing head; and a cooling device for cooling the recording medium in an upstream side with respect to a position where an ink placed on the recording medium is cured, in a carrying direction of the recording medium by the carrying device.

6 Claims, 5 Drawing Sheets

INK JET PRINTER

BACKGROUND OF THE INVENTION

1. Field of the Invention

The present invention relates to an ink jet printer and particularly, to an ink jet printer in which an ink is jetted after being heated.

2. Description of the Related Art

Recently, an ink jet printer has been widely used because images can be easily formed at a low cost in comparison to a method such as a gravure printing method or a flexographic method which needs a plate.

In the field of performing image recording on goods or packing material for goods by using the ink jet printer, material with no ink absorptivity such as resin or metal is generally used for goods or packing for goods. There is known a ink jet printer of photo curable type in which a recording medium made from material with no ink absorptivity and photo curable ink are used, and for example, the ink jetted onto the recording medium is irradiated with light such as ultraviolet rays to cure and fix the ink thereon (for example, refer to JP-2002-283545A).

JP-2002-283545A discloses an example of an ink jet printer in which photo curable ink is used. Specifically, a recording apparatus in JP-2002-283545A is provided with a rotatable and transparent dram shaped intermediate transfer body and a printing head facing the outer periphery of the intermediate transfer body. In a recording operation, ink is jetted from the printing head onto the outer periphery of the intermediate transfer body and the ink placed on the intermediate transfer body is irradiated with light from outside of the intermediate transfer body, and thereafter, the ink irradiated with light is transferred onto the recording medium while rotating the intermediate transfer body. Such a recording method is successful in preventing deterioration of image quality such as beading or bleeding as well as transferring the ink with optimum viscosity onto the recording medium by adjusting the viscosity of the ink placed on the intermediate transfer body.

Generally, photo curable ink has high viscosity in a normal room temperature (around 18 to 28° C.), therefore having a difficulty in stably jetting the ink. For stably jetting the ink, ink viscosity is preferably 3 to 20 mPas, so that an ink jet printer has been developed in which photo curable ink is heated to 40 to 80° C. to have low ink viscosity of 3 to 20 mPas before being jetted.

However, when the photo curable ink with decreased viscosity is jetted from the printing head, the ink spreads until being irradiated with light after placed on the recording medium, thereby causing images to blur.

SUMMARY OF THE INVENTION

An object of the present invention is to suppress spread of ink placed on a recording medium by increasing ink viscosity of ink placed on the recording medium to achieve high image quality.

In accordance with a first aspect of the present invention, the ink jet printer comprises:

an ink heating device for heating an ink whose viscosity decreases as temperature increases;

a printing head for jetting an ink heated by the heating device onto a recording medium;

a carrying device for carrying the recording medium while supporting the recording medium to face a nozzle-plate of the printing head; and a cooling device for cooling the recording medium in an upstream side with respect to a position where an ink placed on the recording medium is cured, in a carrying direction of the recording medium by the carrying device.

Accordingly, since the recording medium is cooled in the upstream side with respect to a position where the ink placed on the recording medium is cured, in the carrying direction, the ink can be cooled before the ink placed on the recording medium is cured. Thus, ink viscosity placed on the recording medium can be increased, thereby preventing the ink spread. This results in obtaining high image quality.

Preferably, in the printer of the first aspect of the present invention, the cooling device and the ink heating device are connected to be capable of conducting heat, and the ink heating device heats an ink by utilizing a heat radiation which is generated from the cooling device by cooling the recording medium.

Accordingly, since the ink heating device heats the ink by utilizing heat radiation generated from the cooling device by cooling the recording medium, heat can be effectively used.

Preferably, in the printer of the first aspect of the present invention, the cooling device and the ink heating device are connected by a heat pipe.

Accordingly, since the cooling device and the ink heating device are connected by the heat pipe, heat exchange is effectively performed.

Preferably, in the printer of the first aspect of the present invention, the cooling device comprises a peltier device.

Accordingly, since the cooling device comprises a peltier device, the recording medium can be cooled by utilizing peltier effect by the peltier device. Moreover, combination of a peltier device and a heatlane plate enables the recording medium to be cooled uniformly.

Preferably, in the printer of the first aspect of the present invention, the cooling device comprises a frigistor device.

Preferably, in the printer of the first aspect of the present invention, the printer further comprises a cap member to cover the nozzle-plate at a time of maintenance of the printing head, the cap member being separated from the nozzle-plate at a time of image recording, wherein the cooling device cools the recording medium between the cap member and the printing head at a time of image recording, and is removed from a position where the recording medium is cooled at a time of maintenance.

Accordingly, since the cooling device is removed from a position where the recording medium is cooled at a time of maintenance, the cap member is not obstructed by the cooling device from covering the nozzle-plate of the printing head, enabling to smoothly perform the maintenance.

Preferably, in the printer of the first aspect of the present invention, a rotary shaft is provided at one end side or the other end side of the cooling device so as to be spaced from the nozzle-plate of the printing head, the rotary shaft extending along a direction perpendicular to the carrying direction, and the cooling device is removed from the position where the recording medium is cooled by rotating the cooling device about 90 degrees around the rotary shaft as a center.

Accordingly, since the cooling device is removed from the position where the recording medium is cooled by rotating the cooling device about 90 degrees around the rotary shaft as a center, the cooling device is adapted to be removed with a simple structure, and moreover, space-saving can be realized.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein;

FIG. 2 is a schematic view of the ink jet printer of FIG. 1 on stand-by;

DETAILED DESCRIPTION OF THE PREFERRED EMBODIMENTS

Hereinafter, the preferred embodiments of the present invention will be described in detail by reference to FIGS. 1 to 6. Incidentally, the description in this column does not limit the technical scope of claims and the meaning of terminologies. Moreover, the affirmative descriptions in the following embodiments of the present invention indicate the best mode, and thus the descriptions do not limit the meaning of terminologies and the technical scope of the present invention.

Figure 1:
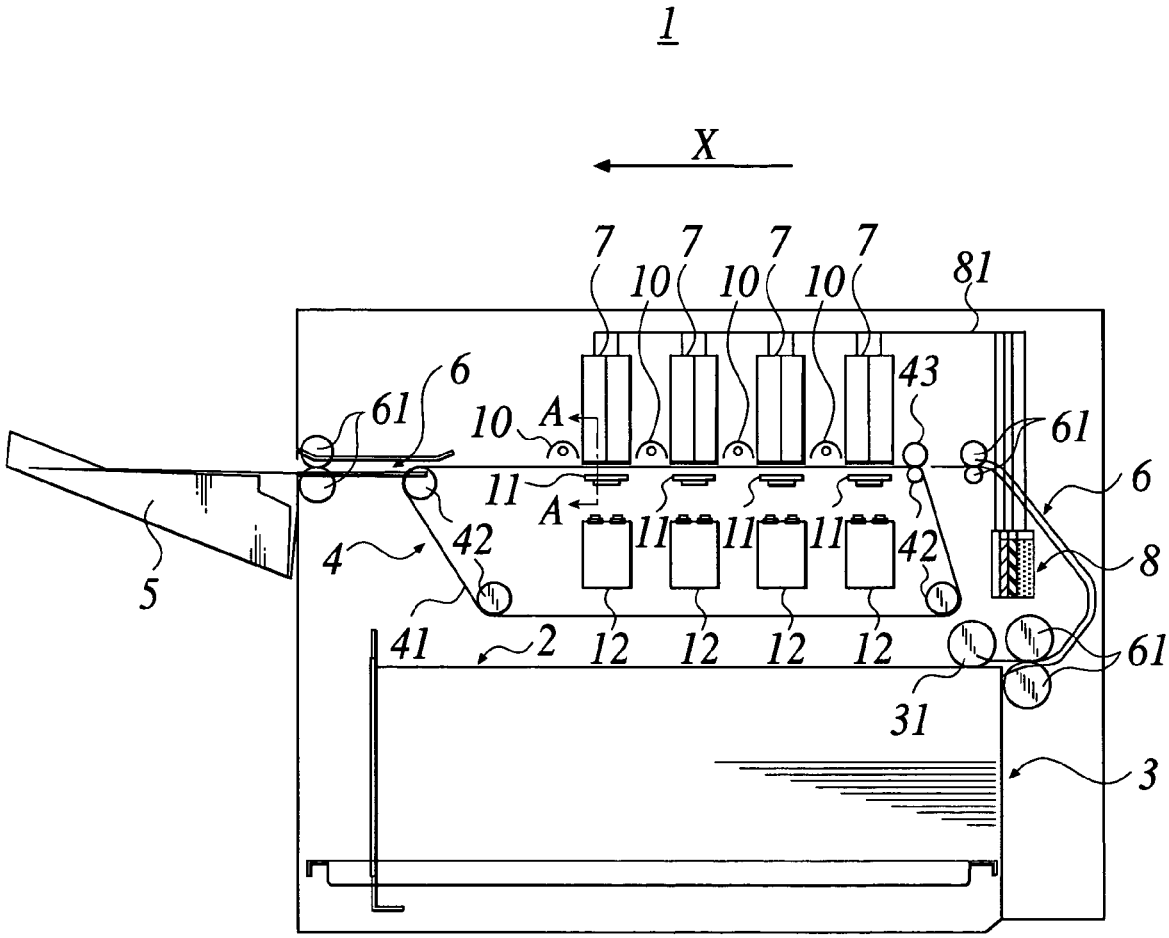
FIG. 1 is a schematic view of an ink jet printer of the embodiment when performing image recording.
Figure 2:
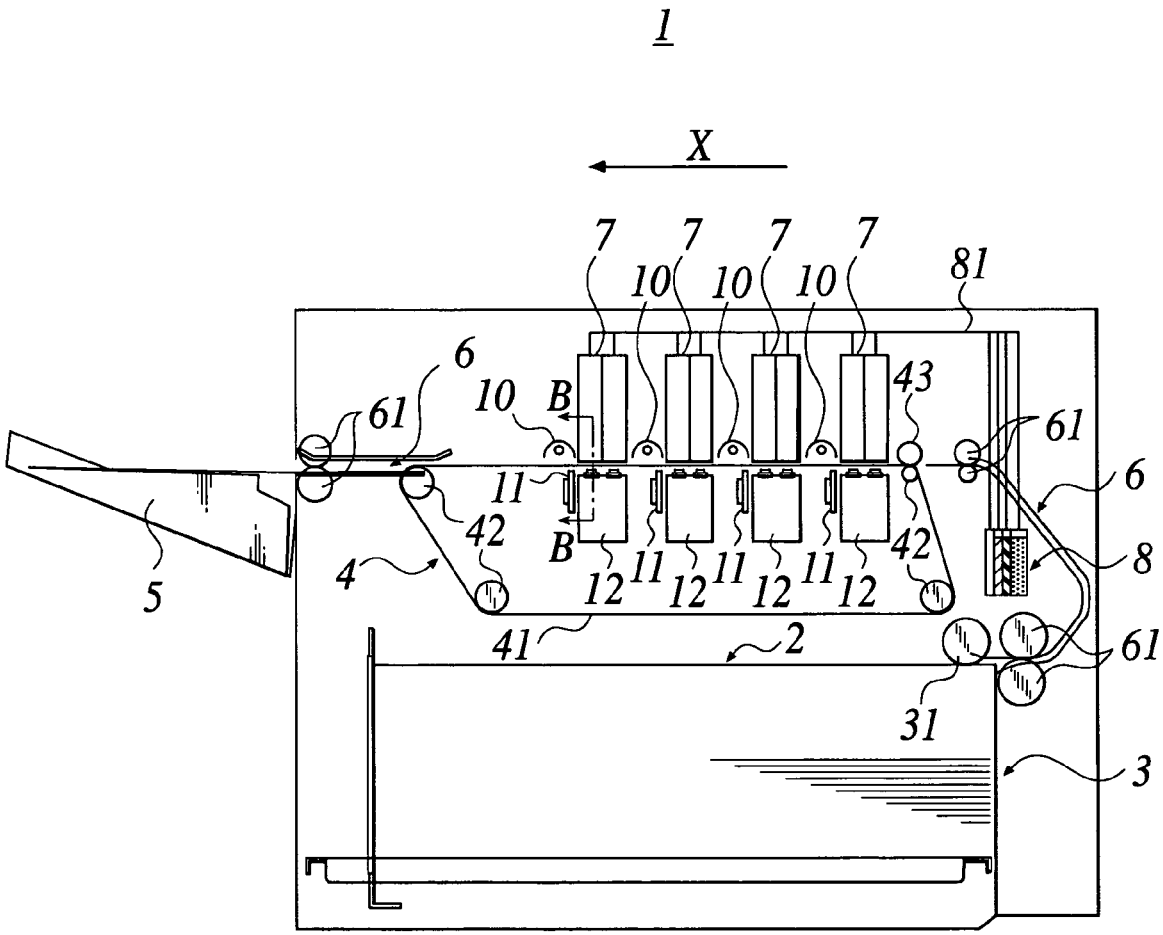
Figure 3:
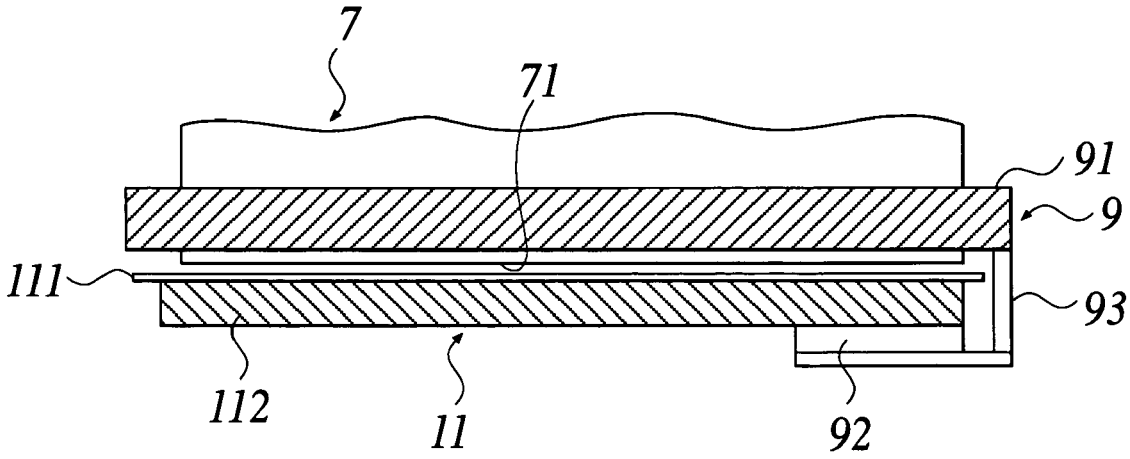
FIG. 3 is a sectional view showing the ink jet printer of FIG. 1 taken along the line A—A.
Figure 4:
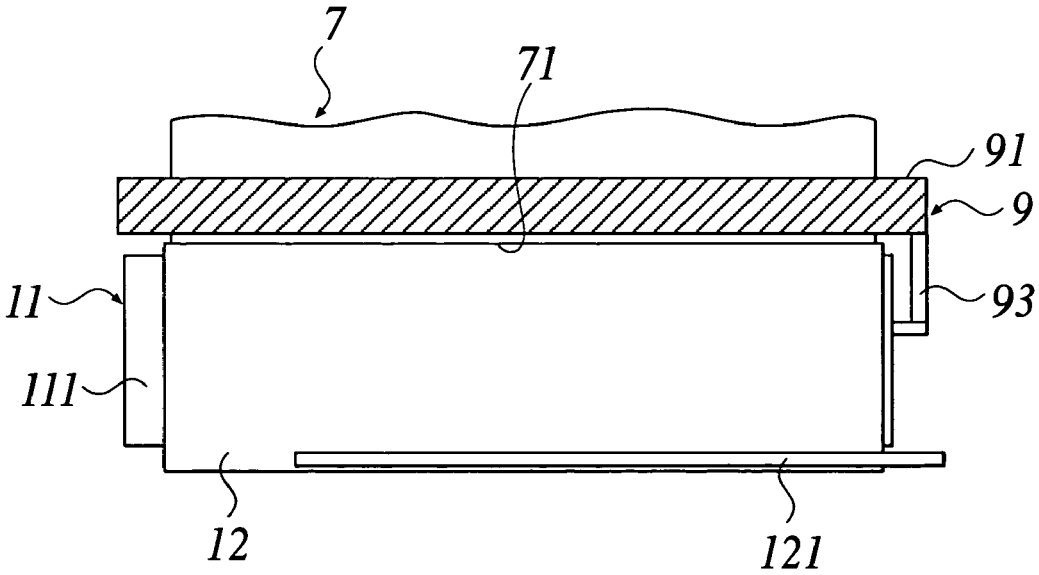
FIG. 4 is a sectional view showing the ink jet printer of FIG. 2 taken along the line B—B.

FIGS. 1 and 2 show one embodiment of an ink jet printer of the present invention, FIG. 3 is a sectional view taken along the line A—A in FIG. 1, and FIG. 4 is a sectional view taken along the line B—B in FIG. 2. As shown in FIGS. 1 and 2, an ink jet printer 1 comprises a paper storage tray 3 for storing a plurality of stacked recording media 2 at a lower portion inside of the ink jet printer 1. A paper feed device 31 is provided at an upper side of one end portion of the storage tray 3 to feed the recording medium 2 to be recorded from the storage tray 3 one by one. The recording medium 2 to be applied includes various types of papers such as a plain paper, a recycled paper and a gloss paper, and a cut sheet shaped recording medium made from a material such as various types of textiles, non-woven fabrics, resin or the like.

A carrying device 4 is provided at an upper portion of the storage tray 3 for carrying the recording medium 2. The carrying device 4 comprises an annular carrying belt 41 for carrying the recording medium 2 in a horizontal direction while supporting it in a flat shape, and the annular carrying belt 41 is rotatably stretched by a plurality of stretching rollers 42. Also, the carrying device 4 comprises a rotatable press roller 43 for pressing the recording medium 2 onto the carrying belt 41 to carry it in a flat shape at a position where the carrying belt 41 and the recording medium 2 starts to contact with each other.

The ink jet printer 1 is provided with a discharge tray 5 on a side portion thereof for discharging the recording medium 2 on which an image was recorded.

Further, the ink jet printer 1 is provided with a carrying path 6 inside thereof. After the recording medium 2 fed from the storage tray 3 was carried along the periphery of the carrying belt 41, the recording medium 2 is guided from the carrying belt 41 to the discharge tray 5 by the carrying path 6. There are provided a plurality pair of carrying rollers 61, 61 . . . at predetermined positions of the carrying path 6 for carrying the recording medium 2 in a carrying direction X.

A plurality of printing heads 7 are provided adjacent to the upper portion of the carrying belt 41 for jetting each color of inks of black (Bk), cyan (C), magenta (M) and yellow (Y) in this order along the carrying direction X onto the recording medium 2. Each printing head 7 is disposed all along the width of the carrying belt 41. A number of nozzles (not shown) are arranged in a nozzle-plate 71 (refer to FIG. 3) of each printing head 7 for jetting ink toward the recording medium 2, and the carrying belt 41 and the printing heads 7 are arranged such that the periphery of the carrying belt 41 faces the nozzle-plates 71. Thereby, the recording medium 2 supported by the carrying belt 41 is adapted to face the nozzle-plates 71 of the printing heads 7.

There are provided ink tanks 8 for storing each color of inks and a pipe 81 for connecting the ink tanks 8 and the printing heads 7 at backside of the carrying belt 41 (right side in FIG. 1), thereby supplying ink from the ink tanks 8 to each printing head 7 through the pipe 81.

The ink used in the embodiment is the type of ink which is cured by irradiation with light, specially, ultraviolet curable ink which is cured by irradiation with ultraviolet rays. The ultraviolet curable ink is classified into radical polymerizable ink having radical polymerizable compound and cationic polymerizable ink having cationic polymerizable compound, both of which are adaptable as the ink to be used in the embodiment. Hybrid ink in which the radical polymerizable ink and the cationic polymerizable ink are combined may also be applied.

Since photo curable ink represented by the above described ultraviolet curable ink has a property that viscosity decreases as temperature increases, the temperature of the ink is needed to be increased at least in the nozzles of the printing heads 7 so as to obtain viscosity necessary for stably jetting ink. Therefore, as shown in FIG. 3, an ink heating device 9 is provided on the outer surface of each printing head 7 for heating the ink in the nozzles. The ink heating device 9 is provided with a heating heatlane plate 91 along the whole width of the printing head 7 near the nozzle-plate 71 in contact relation with the printing head 7, so that the ink inside the nozzles can be heated. The heating heatlane plate 91 is connected to a peltier device 92 as a heat source through a heat pipe 93. There is provided a temperature sensor 94 (refer to FIG. 6) on the heating heatlane plate 91 for detecting temperature of the heating heatlane plate 91.

In the embodiment, the example is described where the ink heating device 9 is provided outside of the printing head 7, however, the ink heating device may be provided at any position as long as viscosity of the ink reached into the nozzles decreases enough to stably jet the ink from the printing head 7. For example, the ink heating device 9 may be provided inside of the printing head 7, at a pipe route of the ink and the pipe 81, or the ink tank 8, thereby enabling to obtain the effect to decrease ink viscosity.

There are a plurality of light irradiation devices 10 for curing surface of ink jetted onto the recording medium 2 from each printing head 7 by irradiating the ink with light having a predetermined wave length, each of which is provided corresponding to each printing head 7, that is, on the downstream side of each printing head 7 in the carrying direction X near the upper portion of the carrying belt 41.

A light source used for the light irradiation device 10 is not particularly limited, however, for example a light emitting diode (LED) array in which LEDs for emitting ultraviolet rays are arranged along the whole width of the carrying belt 41 is preferably used.

A plurality of cooling devices 11 for cooling the recording medium 2 on the carrying belt 41 are provided under the printing heads 7 to face the nozzle-plates 71 through the carrying belt 41, each of which corresponds to one of the printing head 7. The cooling device 11 is provided with a flat shaped facing plate 111 facing the recording medium 2 through the carrying belt 41 as shown in FIG. 3. A cooling heatlane plate 112 is laminated on almost all the back surface of the facing plate 111. The above described peltier device 92 is provided at one end portion of the cooling heatlane plate 112 such that the peltier device 92 contacts with the cooling heatlane plate 112 on the upper surface thereof. The cooling operation would cause dew condensation depending upon the environment where the apparatus is mounted and used. Therefore, a cleaning member to clean droplets due to dew condensation may be provided on a cooling surface which the recording medium 2 contacts. The cleaning member is indispensable in a case that the recording medium 2 has high water absorptivity.

Figure 5A:
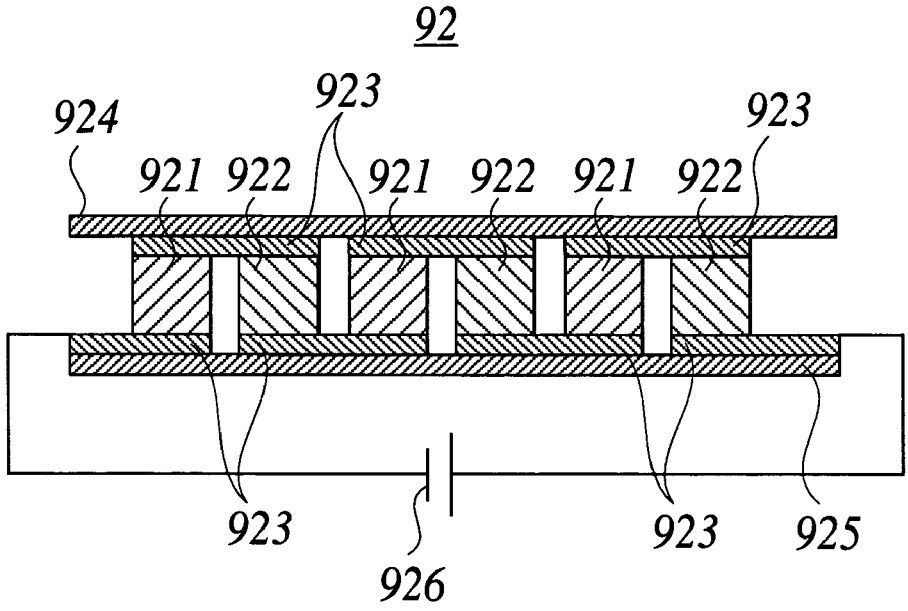
FIG. 5A is a schematic view of a peltier device provide on the ink jet printer of FIG. 1.

Description will be made of the peltier device 92 referring to FIG. 5A. FIG. 5A is a side view showing a schematic configuration of the peltier device 92. As shown in FIG. 5A, a plurality of p-type semiconductors (P-Type Bi2Te3) 921 and n-type semiconductors (N-Type Bi2Te3) 922 as thermoelectric elements are alternately arranged in the peltier device 92. In the p-type and n-type semiconductors 921, 922, one ends of adjacent semiconductors 921, 922 are connected by, for example, a connecting metal piece 923 consisting of copper electrodes. The connecting metal pieces 923 at upper and lower sides are coated with ceramic plates 924, 925, respectively, and a power source 926 is connected to the connecting metal pieces 923 positioned at both ends at lower side. When direct current is supplied by the power source 926, the ceramic plate 924 at upper side absorbs heat and the ceramic plate 925 at lower side radiates the absorbed heat.

Figure 5B:
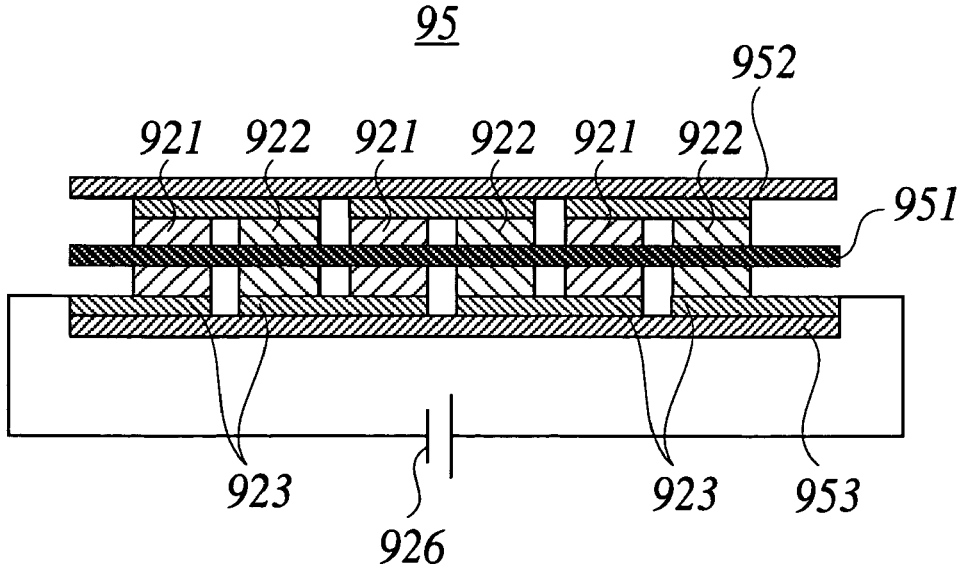
FIG. 5B is a schematic view of a frigistor device provide on the ink jet printer of FIG. 1.

There is known a frigistor device as an improved product of the peltier device. FIG. 5B is a side view showing a schematic configuration of a frigistor device. As shown in FIG. 5B, a plurality of the p-type semiconductors (P-Type Bi2Te3) 921 and the n-type semiconductors (N-Type Bi2Te3) 922 as thermoelectric elements are alternately arranged in the frigistor device 95. These p-type and n-type semiconductors 921, 922 are fixed by a plastic called separator 951, and one ends of adjacent semiconductors 921, 922 are connected by, for example, the connecting metal piece 923 consisting of copper electrodes. The connecting metal pieces 923 at upper and lower sides are coated with insulating materials 952, 953, respectively, and the power source 926 is connected to the connecting metal pieces 923 positioned at both ends at lower side. When direct current is supplied by the power source 926, the insulating material 952 at upper side absorbs heat and the insulating material 953 at lower side radiates the absorbed heat.

Unlike the peltier device 92 which is fixed by a hard ceramic plates 924, 925, the frigistor device 95 is fixed by a plastic called separator 951, so that the frigistor device 95 can be fixed even in the case that a fixing member of the cooling device 11 has a slightly curved surface, and is less likely to be damaged. Further, the peltier device 92 life is decreased due to ON/OFF control (quick cooling), however, the frigistor device 95 is capable of performing quick cooling by ON/OFF control and its life is less decreased due to quick cooling. In view of shortening warm-up time of the apparatus, use of the frigistor device 95 which is an improved product of the peltier device 92 is more effective.

That is, in the cooling device 11 in the embodiment, since the cooling heatlane plate 112 contacts with the ceramic plate for heat absorption 924, the whole surface of the cooling heatlane plate 112 is adapted to be cooled. The cooling control of the cooling device 11 is determined depending upon the size of the peltier device 92 or the frigistor device 95, current or voltage, so that variable current is applied in the case that voltage is specified, and variable voltage is applied in the case that current is specified, thereby enabling to control the cooling temperature.

Since the heat pipe 93 contacts with the ceramic plate for heat radiation 925, the heat radiated from the ceramic plate 925 is conducted to the heating heatlane plate 91 through the heat pipe 93.

There is disposed a rotary shaft (not shown) at one end side of the front side of the cooling device 11 under the printing head 7 to be spaced from the nozzle-plate 71, the rotary shaft extending along the direction perpendicular to the carrying direction X. The rotary shaft and the cooling device 11 are connected. The cooling device 11 is adapted to rotate about 90 degrees downward around the rotary shaft as a center with the rotation of the rotary shaft to make the facing plate 111 be in the vertical state from the horizontal state (refer to FIGS. 2 and 4). The horizontal state of the facing plate 111 is referred to as a cooling state, and the vertical state of the facing plate 111 is referred to as a removed state. In the embodiment, the example is described where the rotary shaft is disposed at one end side of the front side of the cooling device 11, however, the rotary shaft may be disposed at the other end side of the back side.

A plurality of cap members 12 to perform maintenance to the printing heads 7 are liftably provided under the cooling devices 11 so as to correspond to the printing heads 7, respectively. As shown in FIG. 2, when the cap members 12 are moved upward to contact with the nozzle-plates 71 of the printing heads 7, the nozzle-plates 71 and the nozzles are covered with the cap members 12, thereby enabling to keep a moist condition thereof. A suction pump 122 (refer to FIG. 6) is connected to each cap member 12 through a waste ink pipe 121 shown in FIG. 4. When the suction pumps 122 are activated in a state that the nozzle-plates 71 and the nozzles are covered by the cap members 12, the ink adhered to the nozzle-plates 71 or inside the nozzles can be suctioned. The operations to maintain normal operation by keeping the printing heads 7 in a moist condition and suctioning and removing ink are referred to as maintenance.

The cap members 12 move downward as the ink jet printer 1 starts image recording to be separated from the nozzle-plates 71.

In the cooling state, each cooling device 11 is positioned between the cap member 12 and the printing head 7 to obstruct the moving up operation of the cap members 12. Thus, when the cap members 12 move upward, the cooling devices 11 become in the removed state. That is, the cooling devices 11 are removed from the route of the cap members 12.

The carrying belt 41 is interposed between the cap members 12 and the printing heads 7, so that the carrying belt 41 may obstruct the cap members 12 to cover the nozzle-plates 71 of the printing heads 7. In order to prevent this, for example, the carrying belt 41 may be removed from the position just below the printing heads 7 at the time of the maintenance, or the carrying belt 41 may have openings or clearances to be capable of inserting the cap members 12.

Figure 6:
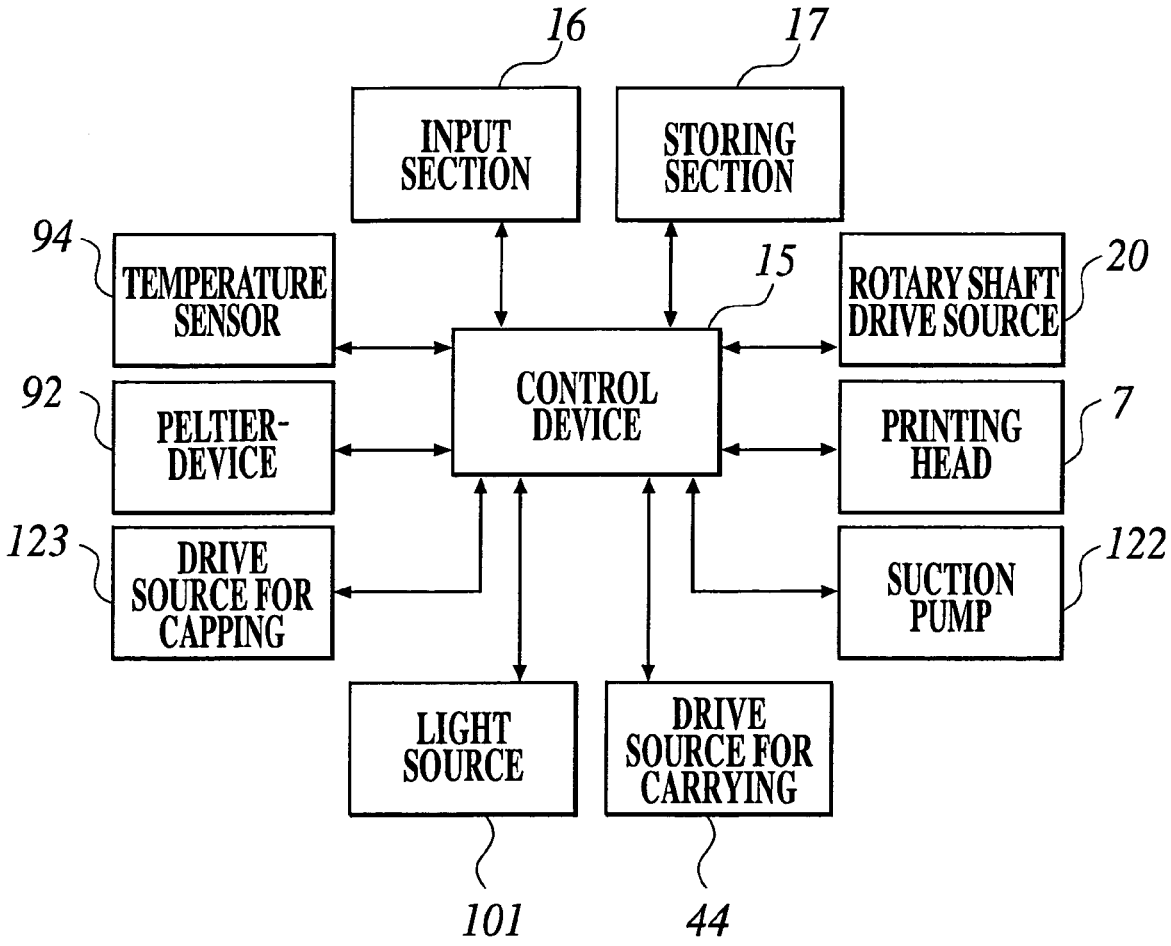
FIG. 6 is a block diagram showing a main control device of the ink jet printer of FIG. 1.

The ink jet printer 1 is provided with a control device 15 for controlling each drive section as shown in FIG. 6. An input section 16 to which instructions for image recording are input, a drive source for carrying 44 as a drive source for the carrying device 4, a light source 101 of the light irradiation device 10, a rotary shaft drive source 20 as a drive source for the rotary shaft, a drive source for capping 123 as a drive source for the cap members 12, the printing heads 7, the storing section 17, a peltier device 92, and a temperature sensor 94 are electrically connected to the control section 15. Moreover, each drive section of the ink jet printer 1 is also connected to the control device 15. The control device 15 controls each section according to the control programs or control data written in the storing section 17.

Operations of the embodiment will be explained.

As shown in FIGS. 2 and 4, when the ink jet printer 1 is on stand-by, the cooling device 11 is in the removed state, and each cap member 12 contacts the nozzle-plate 71 of each printing head 7.

After the image recording start instruction is input to the input section 16, the control device 15 controls the drive source for capping 123 so as to make the cap members 12 be separated from the nozzle-plates 71 of the printing heads 7. Thereafter, the control device 15 controls the rotary shaft drive source 20 to make the cooling devices 11 be in the cooling state. Thereby, the ink jet printer 1 becomes in a state capable of performing image recording as shown in FIG. 1.

The control device 15 controls the peltier device 92 based on the detected result of the temperature sensor 94 so as to make the cooling devices 11 and the ink heating device 9 actuate, enabling the cooling devices 11 to cool the recording medium 2 and the ink heating device 9 to heat ink in the nozzles.

Since viscosity necessary for stably jetting ink from the printing heads 7 is 3 to 20 mPas, the control device 15 controls the peltier device 92 to decrease viscosity of the ink to 3 to 20 mPas. For reducing the spread of the ink placed on the recording medium 2, it is desired to cool the ink with temperature difference of 10° C. or more with respect to the temperature of the ink jetted. Thus, it is preferable to control the peltier device 92 such that the temperature of the recording medium 2 before the ink placed thereon is at least 20° C. or more lower than the temperature of the ink jetted. Since the carrying belt 41 is interposed between the recording material 2 and the cooling devices 11 at the time of image recording, the control device 15 is needed to control the peltier device 92 in view of heat conductivity, thickness or the like of the carrying belt 41.

When the detected result of the temperature sensor 94 is 80° C. or more, it is difficult to stably jet ink because ink viscosity is too decreased, therefore, the temperature of the printing heads 7 needs to be controlled. For example, the temperature of the printing heads 7 can be controlled as follows. The heating heatlane plate 91 capable of contacting with or being apart from the printing head 7 may be applied. In this case, when the detected result of the temperature sensor 94 becomes 80° C. or more, the printing head 7 is separated from the heating heatlane plate 91, thereby insulting heat conduction to the printing head 7. Also, a cooling fan for the heating heatlane plate 91 may be provided. In this case, when the detected result of the temperature sensor 94 becomes 80° C. or more, the cooling fan is operated for cooling. Therefore, the temperature of each printing head 7 can be controlled.

When the ink in the nozzles is heated to obtain the temperature for stably jetting the ink, the control device 15 activates the paper feed device 31 to feed the uppermost recording medium 2 stored in the storing tray 3, and then rotates the carrying roller 61 to carry the recording medium 2 fed. When the recording medium 2 reaches to the pressure roller 43, the control device 15 activates the pressure roller 43 to press the recording medium 2 to the periphery of the carrying belt 41 from the edge thereof. When the recording medium 2 is carried to the position where the printing heads 7 are mounted with the rotation of the carrying belt 41, the recording medium 2 is cooled by the cooling effect by the cooling device 11. The control device 15 controls the printing heads 7 to jet ink to the recording medium 2. The ink placed on the recording medium 2 was cooled to have high viscosity, so that the ink is unlikely to spread. Hereupon, the ink placed on the recording medium 2 is irradiated with light emitted from the light irradiation device 10 to be cured.

After an image is formed on the recording medium 2, when the recording medium 2 is carried and the edge thereof is separated from the carrying belt 41, the recording medium 2 is carried to the carrying roller 61 to be discharged to outside from the discharge tray 5.

After the completion of the image recording, the control device 15 controls the rotary shaft drive source 20 to make the cooling device be in the removed condition, and then, controls the drive source for capping 123 so as to make the capping members 12 be contact with the nozzle-plates 71 of the printing heads 7.

As described above, according to the ink jet printer 1 in this embodiment, the recording medium 2 is cooled by the cooling device 11 at the position which is in the upstream side with respect to the position where the ink placed on the recording medium 2 is cured in the carrying direction X, so that the ink placed on the recording medium 2 can be cooled before being cured. Thus, ink viscosity placed on the recording medium 2 can be increased, thereby preventing the ink spread. This results in obtaining high image quality.

The cooling device 11 is connected to the ink heating device 9, capable of conducting heat through the heat pipe 93 bilaterally. Thus, the ink heating device 9 utilizes heat radiation which is caused when the cooling device 11 cools the recording medium 2 for heating ink, thereby heat can be utilized effectively.

The cooling device 11 rotates about 90 degrees around the rotary shaft as a center to be removed from the position where the recording medium 2 is cooled, so that the cooling device 11 can be removed with a simple structure, and moreover, space-saving can be realized.

It is to be understood that the present invention is not limited to the embodiment and appropriate changes may be made.

For example, the example was explained in the case that photo curable ink represented by ultraviolet curable ink is used as the ink whose ink viscosity decreases as the temperature increases, however, the ink is not limited thereto as long as ink viscosity decreases as the temperature increases, and for example, water-based ink or oil-based ink other than the ink in the embodiment may also be used.

In this embodiment, the configuration is such that the temperature sensor 94 detects the temperature of the heating heatlane plate 911 to indirectly detect the temperature of the ink, however, it may be a configuration wherein, for example, a temperature sensor is disposed in a nozzle to directly detect the temperature of the ink.

Further in this embodiment, the example is explained in the case that the cooling devices 11 are disposed at positions to face the nozzle-plates 71 of the printing heads 7, respectively, however, they may be disposed at any position as long as each cooling device 11 is positioned on the upstream side with respect to a position where the ink placed on the recording medium 2 is cured in the carrying direction X. For example, in this embodiment, since the ink is cured by the irradiation with light from the light irradiation device 10, it is preferable that the cooling device 10 is disposed on the upstream side with respect to a position to face the light irradiation device 10.

The entire disclosure of Japanese Patent Application No. Tokugan 2003-295263 which was filed on Aug. 19, 2003, including specification, claims, drawings and summary are incorporated herein by reference in its entirety.

What is claimed is:

1. An ink jet printer, comprising:

an ink heating device for heating an ink whose viscosity decreases as temperature increases;

a printing head for jetting the ink heated by the heating device onto a recording medium;

a carrying device for carrying the recording medium while supporting the recording medium to face a nozzle-plate of the printing head; and a cooling device for cooling the recording medium in an upstream side, with respect to a position where the ink placed on the recording medium is cured, in a carrying direction of the recording medium by the carrying device, wherein the cooling device and the ink heating device are connected to be capable of conducting heat, and wherein the ink heating device heats the ink by utilizing heat radiation generated from the cooling device.

2. The printer of claim 1, wherein the cooling device and the ink heating device are connected by a heat pipe.

3. The printer of claim 1, wherein the cooling device includes a peltier device.

4. The printer of claim 1, wherein the cooling device includes a frigistor device.

5. An ink jet printer comprising:

an ink heating device for heating an ink whose viscosity decreases as temperature increases;

a printing head for jetting the ink heated by the heating device onto a recording medium;

a carrying device for carrying the recording medium while supporting the recording medium to face a nozzle-plate of the printing head;

a cooling device for cooling the recording medium in an upstream side, with respect to a position where the ink placed on the recording medium is cured, in a carrying direction of the recording medium by the carrying device; and a cap member to cover the nozzle-plate at a time of maintenance of the printing head, the cap member being separated from the nozzle-plate at a time of image recording, wherein the cooling device cools the recording medium between the cap member and the printing head at the time of image recording, and wherein the cooling device is removed from a position where the recording medium is cooled at a time of maintenance.

6. The printer of claim 5, wherein a rotary shaft is provided at one end side or the other end side of the cooling device so as to be spaced from the nozzle-plate of the printing head, the rotary shaft extending along a direction perpendicular to the carrying direction, and the cooling device is removed from the position where the recording medium is cooled by rotating the cooling device about 90 degrees around the rotary shaft as a center.

* * * * *